US009067730B2

(12) United States Patent
Curotto

(10) Patent No.: US 9,067,730 B2
(45) Date of Patent: Jun. 30, 2015

(54) LIGHT-WEIGHT COLLECTION BIN AND WASTE SYSTEMS INCLUDING A LIGHT-WEIGHT COLLECTION BIN

(75) Inventor: John Michael Curotto, Sonoma, CA (US)

(73) Assignee: THE CUROTTO-CAN, LLC., Chattanooga, TN (US)

( * ) Notice: Subject to any disclaimer, the term of this patent is extended or adjusted under 35 U.S.C. 154(b) by 0 days.

(21) Appl. No.: 13/459,813

(22) Filed: Apr. 30, 2012

(65) Prior Publication Data

US 2012/0273498 A1 Nov. 1, 2012

Related U.S. Application Data

(60) Provisional application No. 61/480,955, filed on Apr. 29, 2011.

(51) Int. Cl.

| | |
|---|---|
| ***B65D 90/00*** | (2006.01) |
| ***B65F 1/06*** | (2006.01) |
| ***B65F 3/04*** | (2006.01) |
| ***B65F 1/12*** | (2006.01) |
| *B65F 3/02* | (2006.01) |

(52) U.S. Cl.

CPC . *B65F 1/06* (2013.01); *B65F 3/041* (2013.01); *B65F 1/122* (2013.01); *B65F 2003/0279* (2013.01); *B65F 2003/0263* (2013.01); *B65F 2003/023* (2013.01); *B65F 2210/184* (2013.01)

(58) Field of Classification Search

USPC ..... 220/9.4, 9.1, 9.2, 9.3, 495.06, 908, 666, 220/668; 206/600; 383/6, 12, 17–19, 117, 383/16, 22, 24, 33; 298/8 H, 11, 24, 38

See application file for complete search history.

(56) References Cited

U.S. PATENT DOCUMENTS

| | | | | |
|---|---|---|---|---|
| 123,267 | A | | 1/1872 | Large |
| 254,237 | A | | 2/1882 | Pickering |
| 1,470,630 | A | | 10/1923 | Mahr |
| 2,069,499 | A | | 2/1937 | Marin et al. |
| 2,913,029 | A | * | 11/1959 | Paton ..... 220/9.2 |
| 3,112,834 | A | | 12/1963 | Dempster et al. |
| 3,215,182 | A | * | 11/1965 | Silverman ..... 312/35 |
| 3,321,036 | A | | 5/1967 | Keenan et al. |
| 3,597,786 | A | * | 8/1971 | Ruhl ..... 15/79.1 |
| 3,828,899 | A | | 8/1974 | Scott |
| 4,042,137 | A | | 8/1977 | Hughes et al. |
| 4,143,451 | A | | 3/1979 | Craig et al. |
| 4,152,979 | A | | 5/1979 | Schmidt |

(Continued)

FOREIGN PATENT DOCUMENTS

| | | |
|---|---|---|
| EP | 0860380 | 8/1998 |
| GB | 2082142 | 3/1982 |

OTHER PUBLICATIONS

Curotto, John Michael, "Curotto Scale System Project", Dec. 1, 2008, 12 pgs.

*Primary Examiner* — Anthony Stashick
*Assistant Examiner* — James Way

(57) ABSTRACT

This disclosure describes methods and apparatuses for reducing emissions of vehicles, such as waste collection vehicles. The disclosure describes a novel light-weight collection bin that has a weight that is less than previously utilized collection bins. The light-weight collection bin utilizes a bag made of a fabric-like material in combination with a collection bin body that frames the bag to form the light-weight collection bin.

25 Claims, 13 Drawing Sheets

(56) References Cited

U.S. PATENT DOCUMENTS

| | | | | |
|---|---|---|---|---|
| 4,155,584 | A | 5/1979 | Pracchia | |
| 4,175,903 | A | 11/1979 | Carson | |
| 4,575,300 | A | 3/1986 | George | |
| 4,580,940 | A | 4/1986 | Sheaves | |
| 4,631,777 | A | 12/1986 | Takimoto | |
| 4,687,405 | A | 8/1987 | Olney | |
| 4,722,270 | A | 2/1988 | Wall | |
| 4,726,726 | A | 2/1988 | Dossena et al. | |
| 4,889,462 | A | 12/1989 | Naab et al. | |
| 5,002,450 | A | 3/1991 | Naab | |
| 5,007,786 | A | 4/1991 | Bingman | |
| 5,070,687 | A | 12/1991 | Schweigert | |
| 5,094,487 | A | 3/1992 | Drewry | |
| 5,105,967 | A | 4/1992 | Horpestad | |
| 5,119,894 | A | 6/1992 | Crawford et al. | |
| 5,135,129 | A | 8/1992 | Joly | |
| 5,149,153 | A | 9/1992 | Drewry et al. | |
| 5,209,312 | A | 5/1993 | Jensen | |
| 5,218,781 | A * | 6/1993 | Miller | 43/100 |
| 5,224,744 | A | 7/1993 | Michelutti | |
| 5,230,393 | A | 7/1993 | Mezey | |
| 5,244,109 | A | 9/1993 | Mullett et al. | |
| 5,265,311 | A | 11/1993 | Gard | |
| 5,266,000 | A | 11/1993 | LeBlanc, Jr. | |
| 5,331,763 | A * | 7/1994 | Miller | 43/100 |
| 5,415,314 | A | 5/1995 | McCollum | |
| 5,447,405 | A | 9/1995 | Bayne et al. | |
| 5,565,846 | A | 10/1996 | Geiszler et al. | |
| 5,622,277 | A * | 4/1997 | Van Giezen et al. | 220/6 |
| 5,641,947 | A | 6/1997 | Riddle, Jr. | |
| 5,738,395 | A | 4/1998 | Probst | |
| 5,784,947 | A | 7/1998 | Bayne et al. | |
| 5,807,056 | A | 9/1998 | Osborn et al. | |
| 5,826,485 | A | 10/1998 | Bayne et al. | |
| 5,837,945 | A | 11/1998 | Cornwell et al. | |
| 5,941,405 | A * | 8/1999 | Scales et al. | 220/1.5 |
| 6,027,299 | A | 2/2000 | Williams | |
| 6,139,244 | A | 10/2000 | VanRaden | |
| 6,167,795 | B1 | 1/2001 | Bayne et al. | |
| 6,191,691 | B1 | 2/2001 | Serrault | |
| 6,220,647 | B1 | 4/2001 | Winkler | |
| 6,224,317 | B1 | 5/2001 | Kann et al. | |
| 6,253,376 | B1 * | 7/2001 | Ritter | 2/24 |
| 6,422,800 | B1 | 7/2002 | Reichow et al. | |
| 6,666,485 | B1 | 12/2003 | Moret | |
| 6,687,656 | B2 | 2/2004 | Durbin et al. | |
| 6,749,076 | B2 * | 6/2004 | Fingerhut et al. | 220/1.5 |
| 6,761,414 | B1 | 7/2004 | Broberg | |
| 6,773,054 | B2 | 8/2004 | Martini | |
| 6,821,074 | B2 | 11/2004 | Schreiber et al. | |
| 6,863,249 | B1 | 3/2005 | Alvord | |
| 7,000,289 | B2 | 2/2006 | Cedrone | |
| 7,146,294 | B1 | 12/2006 | Waitkus, Jr. | |
| 7,151,231 | B2 | 12/2006 | Kamakau | |
| 7,198,166 | B2 * | 4/2007 | Sholinder | 220/4.33 |
| 7,210,890 | B2 * | 5/2007 | Curotto et al. | 414/408 |
| 7,296,704 | B2 * | 11/2007 | Ferrini | 220/1.5 |
| 7,313,887 | B2 * | 1/2008 | Hibbs et al. | 43/105 |
| 7,347,657 | B2 | 3/2008 | Brunn | |
| 7,390,159 | B2 | 6/2008 | Rimsa et al. | |
| 7,396,996 | B1 | 7/2008 | Shotey et al. | |
| 7,607,628 | B2 * | 10/2009 | Elder et al. | 248/346.02 |
| 7,633,020 | B2 | 12/2009 | Santi et al. | |
| 7,737,372 | B2 | 6/2010 | Dougherty et al. | |
| 7,897,884 | B2 | 3/2011 | Harish | |
| 8,330,059 | B2 | 12/2012 | Curotto | |
| 8,550,764 | B2 * | 10/2013 | Rowland et al. | 414/408 |
| 2001/0000464 | A1 * | 4/2001 | Beale | 414/607 |
| 2005/0095096 | A1 | 5/2005 | Curotto et al. | |
| 2006/0127202 | A1 | 6/2006 | Tryggvason | |
| 2007/0278019 | A1 | 12/2007 | Santi et al. | |
| 2010/0089916 | A1 * | 4/2010 | Fielden | 220/4.28 |
| 2010/0183410 | A1 | 7/2010 | Curotto | |
| 2010/0206642 | A1 | 8/2010 | Curotto | |
| 2010/0281654 | A1 | 11/2010 | Curotto | |
| 2011/0038696 | A1 | 2/2011 | Ummel, Jr. | |
| 2011/0188976 | A1 | 8/2011 | Rowland et al. | |
| 2011/0266296 | A1 | 11/2011 | Curotto | |
| 2013/0195590 | A1 * | 8/2013 | Goedken | 414/408 |
| 2014/0010630 | A1 | 1/2014 | Curotto | |
| 2014/0182951 | A1 | 7/2014 | Curotto | |

* cited by examiner

LIGHT-WEIGHT COLLECTION BIN AND WASTE SYSTEMS INCLUDING A LIGHT-WEIGHT COLLECTION BIN

INTRODUCTION

Several types of waste collection vehicles exist. Waste collection vehicles can be front loaders, rear loaders, automated side loaders, and grapple trucks. Waste collection vehicles are typically utilized to pick up quantities of waste for hauling to a determined area, such as a landfill, transfer station, or material recovery facility. Waste collection vehicles can be further utilized or modified to collect recyclables for transport to a recycling facility.

The allocation of waste removal equipment has been improved by the use of large trucks having compaction capabilities extending their effective range and capacity between unloadings. Further, the vehicles have been improved by the addition of specialized hoists to lift trash containers into the truck. These collection vehicles have also been improved by the utilization of collection/intermediate bins. The collection bin allows a front and/or side loading waste collection vehicle designed for the collection of large waste containers, such as dumpsters, to collect smaller, non-commercial waste containers.

However, these additional components increase the weight of the waste collection vehicle, which increases the fuel emission of the waste collection vehicles. Waste collection vehicles are often subject to emission testing.

REDUCING VEHICLE EMISSIONS

The disclosure describes methods and apparatuses for reducing emissions of vehicles, such as waste collection vehicles. The disclosure describes a novel light-weight collection bin that has a weight that is less than previously utilized collection bins. The light-weight collection bin utilizes a bag made of a fabric-like material in combination with a collection bin body that frames the bag to form the light-weight collection bin.

In part, this disclosure describes a light-weight collection bin for reducing vehicle emissions including a collection bin bag, a collection bin body, a plurality of top bar attachments, an interior bar, a lower rear bar, and a lifting device attachment. The collection bin bag is a fabric-like material configured to form a receptacle. The collection bin bag includes four sides attached to a base, an exterior channel attached to a rear side of the four sides, and a plurality of flanges. Each of the plurality of flanges extends from a top edge of a different one of the four sides. The collection bin body is made of a substantially non-flexible material. The collection bin body is a frame that includes at least four top bars, at least four bottom bars, and at least two side bars connecting the top bars to the bottom bars. The plurality of top bar attachments include intermediate plates. Further, the plurality of top bar attachments attach to each of the flanges extending from the top edges of each of the four sides of the collection bin bag to the collection bin body. The interior bar attaches through a right side and a left side of the four sides of the collection bin bag to a first side bar and a opposite second side bar of the at least two side bars of the collection bin body. The interior bar is positioned adjacent to a corner formed by a front side's attachment of the four sides to the base. The lower rear bar attaches the rear side of the collection bin bag via the exterior channel to the first side bar and the opposite second side bar of the collection bin body. The lifting device attachment is located on the collection bin body and is configured to allow a lifting device of a waste collection vehicle to be attached to the collection bin.

Yet another aspect of this disclosure describes a waste collection system for reducing fuel emission. The waste collection system includes a waste collection vehicle and a light-weight collection bin. The waste collection vehicle includes an automated lifting apparatus. The light-weight collection bin includes a collection bin bag, a collection bin body, at least one body attachment, and a lifting device attachment. The collection bin bag is a fabric-like material configured to form a receptacle. The collection bin body is made of a substantially non-flexible material and is configured to frame the collection bin bag when the collection bin bag is attached to the collection bin body. The at least one body attachment attaches the collection bin bag to the collection bin body. The lifting device attachment is located on the collection bin body and provides a mechanism for attaching a lifting device of the waste collection system to the collection bin body of the light-weight collection bin.

An additional aspect of this disclosure describes a light-weight collection bin for reducing vehicle emissions including a collection bin bag, a collection bin body, a lifting device attachment, and at least one body attachment. The collection bin bag is a fabric-like material configured to form a receptacle. The collection bin body is made of a substantially non-flexible material and is configured to frame the collection bin bag when the collection bin bag is attached to the collection bin body. The lifting device attachment is located on the collection bin body and is configured to allow an automated lifting device of waste collection vehicle to be attached to the collection bin. The at least one body attachment attaches the collection bin bag to the collection bin body. Further, the collection bin bag weighs less than 35 pounds.

These and various other features as well as advantages which characterize the systems and methods described herein will be apparent from a reading of the following detailed description and a review of the associated drawings. Additional features are set forth in the description which follows, and in part will be apparent from the description, or may be learned by practice of the technology. The benefits and features of the technology will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The following drawing figures, which form a part of this application, are illustrative of embodiments of systems and methods described below and are not meant to limit the scope of the invention in any manner.

DETAILED DESCRIPTION

Figure 1:
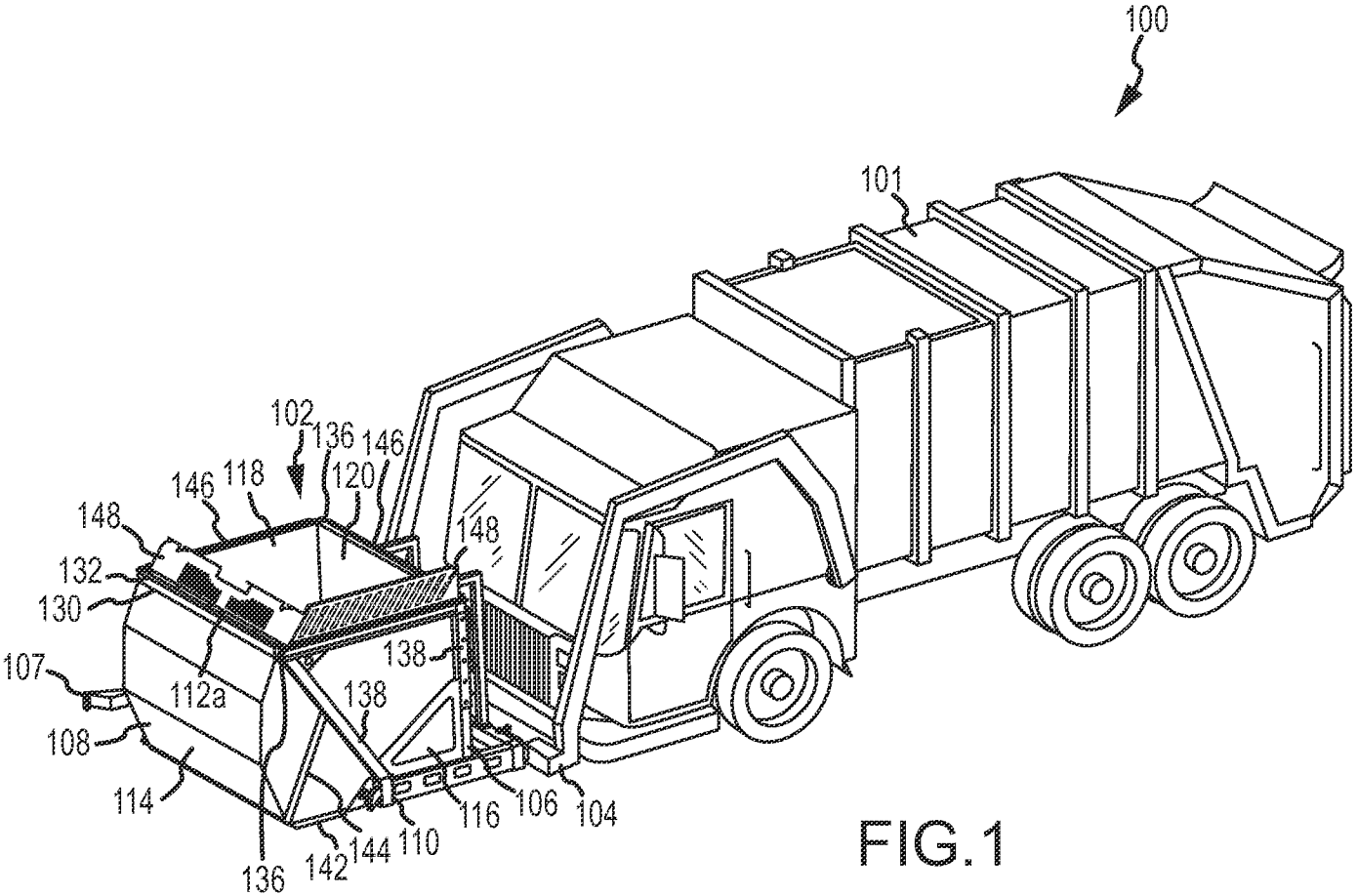
FIG. 1 is an isometric view of one embodiment of a waste collection system.

Although the techniques introduced above and discussed in detail below may be implemented in a variety of waste collection vehicles, the present disclosure will discuss the implementation of these techniques in the context of a collection vehicle for use in providing removal and transport of materials, such as waste and recyclables. The reader will understand that the technology described herein for a collection bin in the context of a waste collection vehicle could be adapted for use with other systems or vehicles.

Waste collection vehicles with collection bins are used to provide the removal and transport of items such as municipal solid waste, recyclables, dirt, rock, coal, minerals, green waste (e.g., yard waste), and/or any other material commonly collected and transported. As utilized herein, the terms "recyclables" or "waste" are not limiting and are understood to be interchangeable with any other material that is commonly collected and transported.

While operating a waste collection vehicle with a collection bin, it is desirable to lower the emissions of the waste collection vehicle. Accordingly, a collection vehicle with a lighter collection bin is desirable.

Waste collection vehicles with lower total weight have better fuel emissions. However, a system for decreasing the overall weight in a waste collection vehicle, while maintaining the waste collection vehicle's efficiency and effectiveness, is not readily apparent. Accordingly, several changes were made to try and reduce the overall weight of the waste collection vehicle. Through experimentation it was determined that replacement of a semi-rigid collection bin with a collection bin bag and body (i.e., frame) provided for an effective collection bin while providing a significant weight decrease for the overall system.

A light-weight collection bin as disclosed herein provides for a body (or collection bin body) and a bag (or a collection bin bag). The body provides a structurally sound frame for holding the bag, which is made of a fabric-like material. The fabric-like material of the bag provides for a lightweight collection bin. For example, the bag may weigh less than 35 pounds. For instance, previously utilized collection bins weigh between approximately 1640 to 1680 pounds. Collection bins with fabric-like material weigh at least 200 pounds less than previously utilized collection bins that utilized solid or substantially inflexible bin materials. This significant reduction of weight compared to previously utilized collection bins help to reduce the overall weight of collection systems.

Because these collection bins weighs less, they are moved with less energy and accordingly reduce overall fuel consumption and vehicle emissions for waste collection vehicles when compared to waste collection vehicles that utilize rigid collection bins. Further, the fabric-like material of the collection bin bag reduces the overall weight of the collection bin decreasing the wear and tear on the waste collection vehicle resulting in lower maintenance costs and/or an increased life-span for the collection vehicle.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the scope of the equipment and methods described herein.

Reference will now be made in detail to various features of the present disclosure that are illustrated in the accompanying drawings. Wherever possible, the same reference numbers will be used throughout the drawings to refer to the same or like parts.

Figure 4:
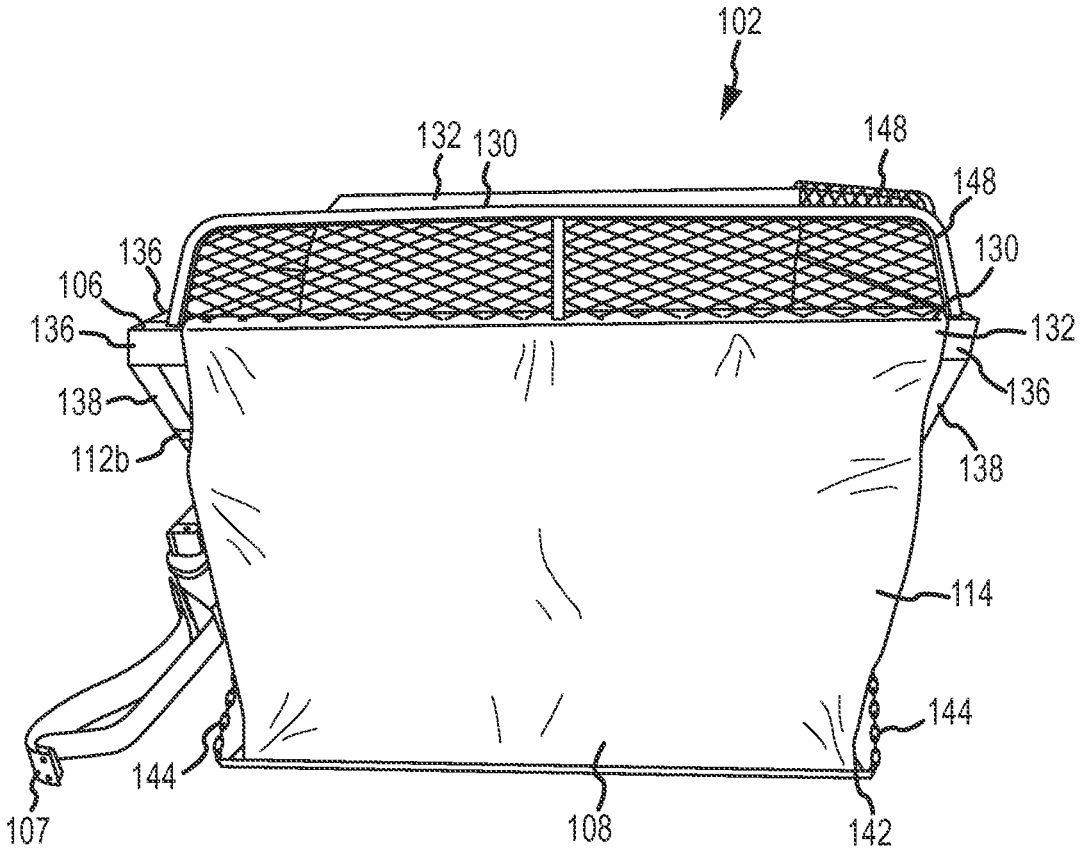
FIG. 4 is a front view of one embodiment of a collection bin.
Figure 5:
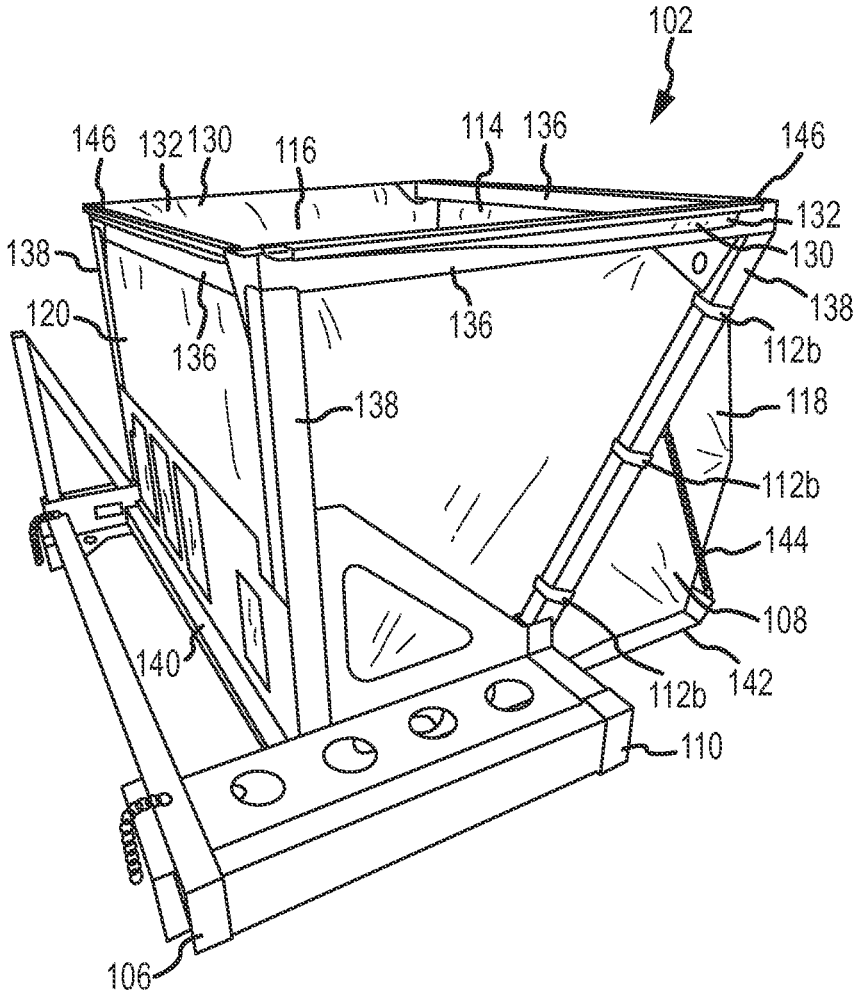
FIG. 5 is a rear, left side, isometric view of one embodiment of a collection bin.
Figure 6:
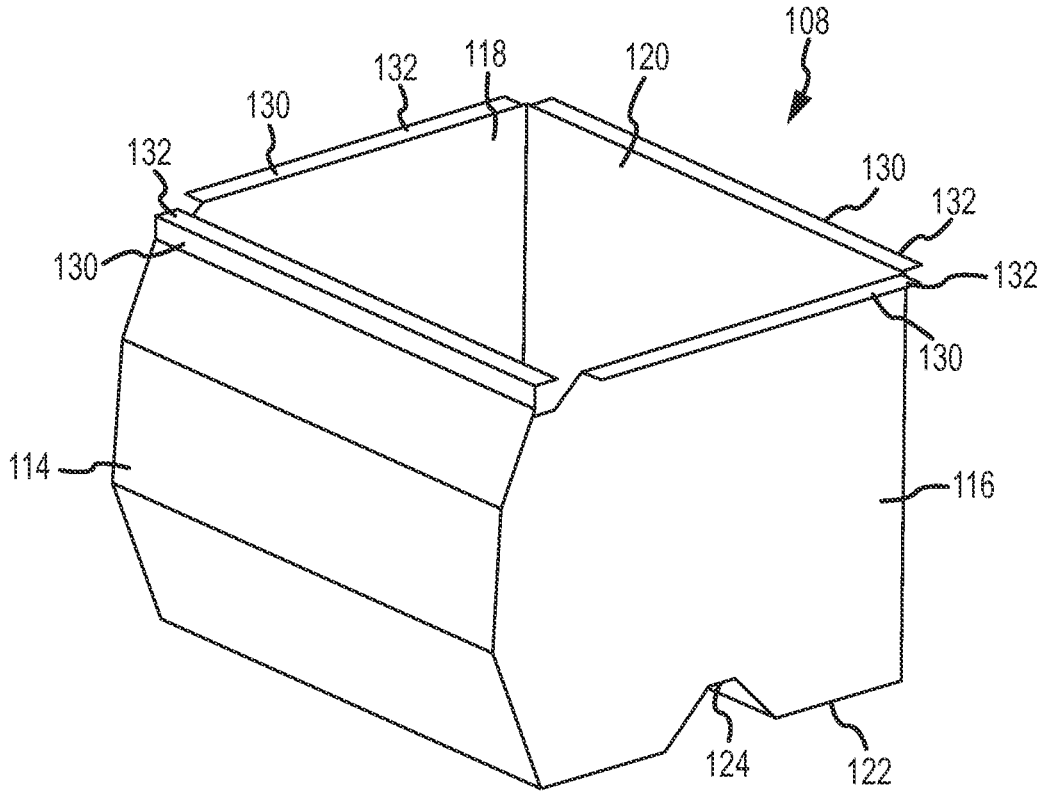
FIG. 6 is a front, right side, isometric view of one embodiment of a collection bin bag.
Figure 7:
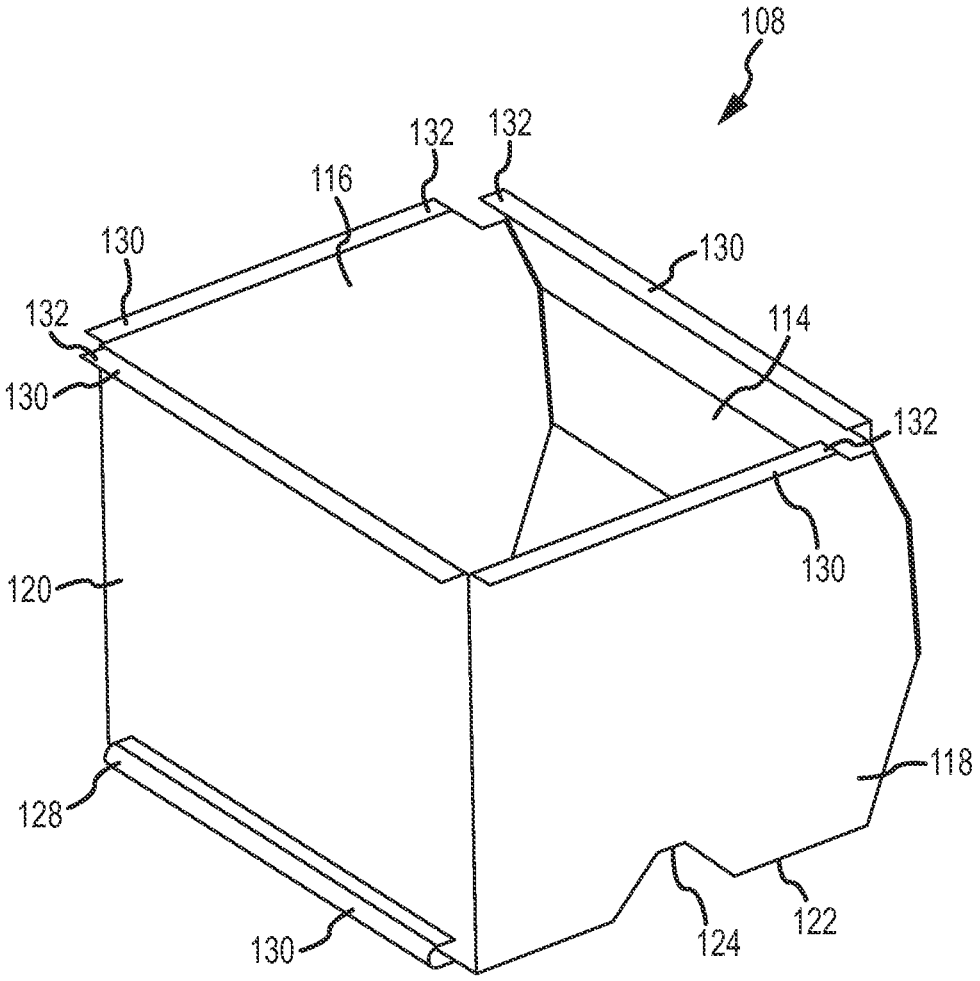
FIG. 7 is a rear, left side, isometric view of one embodiment of a collection bin bag.
Figure 8:
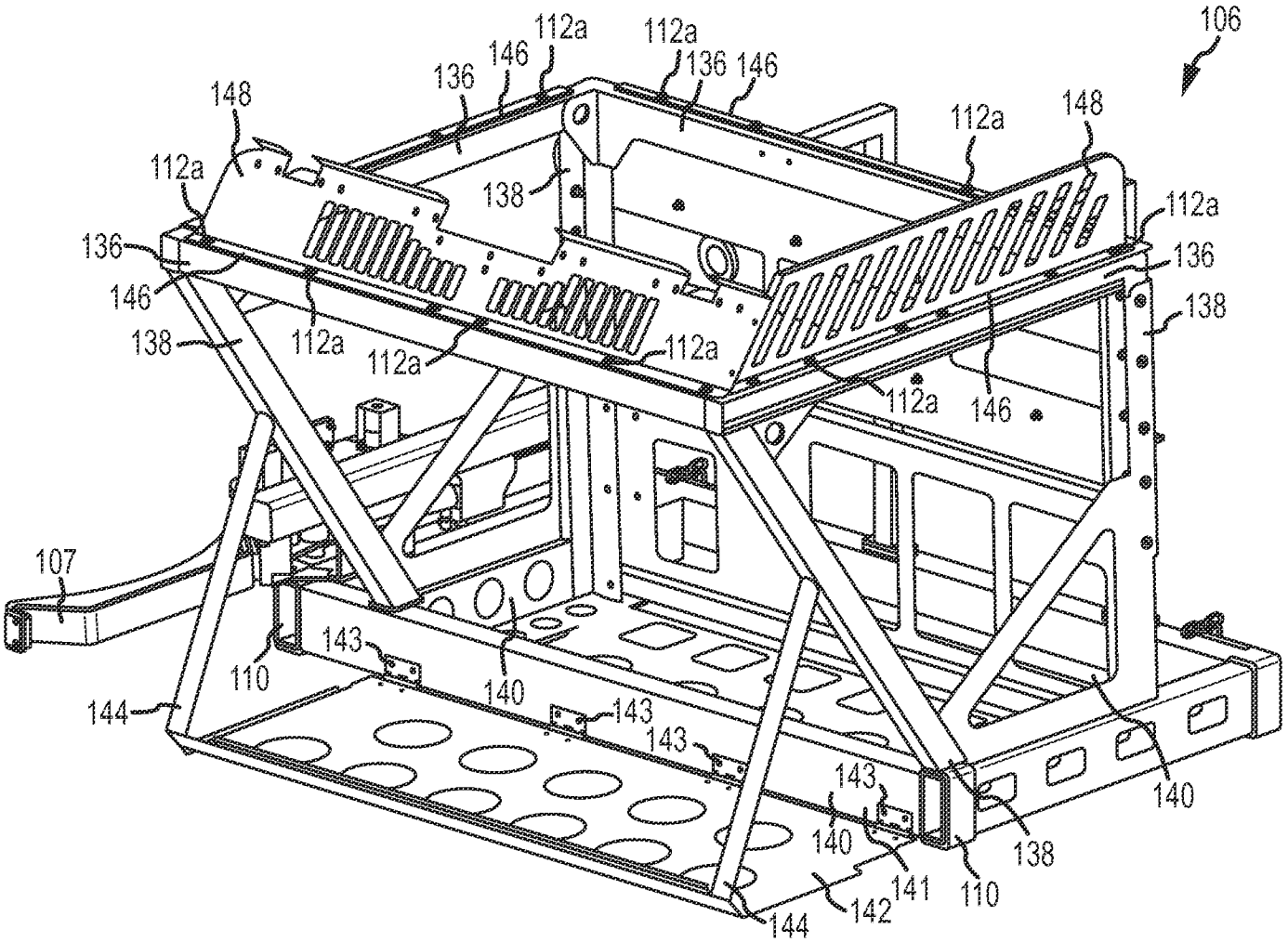
FIG. 8 is a front, right side, isometric view of one embodiment of a collection bin body.
Figure 9:
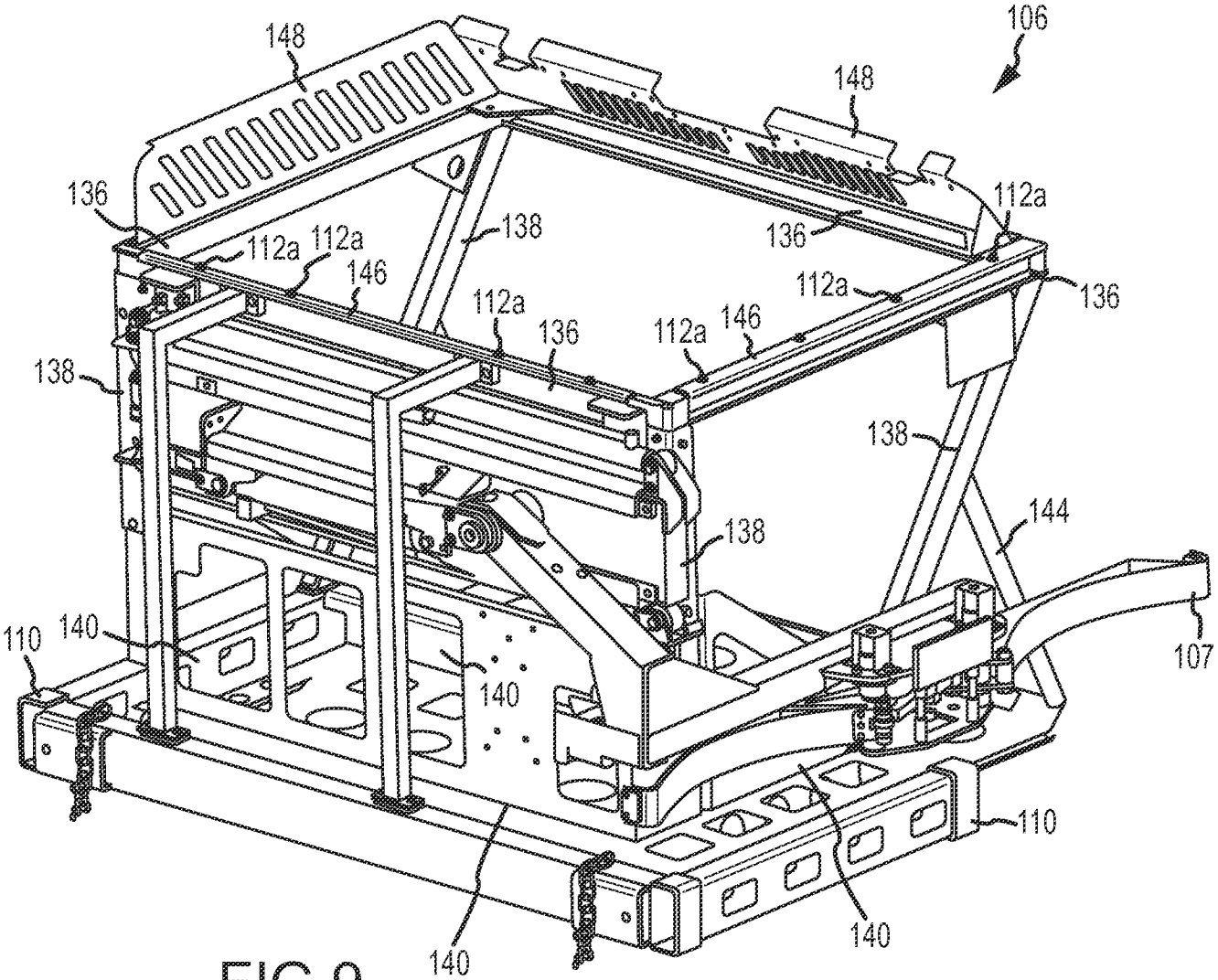
FIG. 9 is a rear, left side, isometric view of one embodiment of a collection bin body.

FIG. 1 illustrates an embodiment of waste collection system 100. FIGS. 2-5 and 10-12 illustrate embodiments of a light-weight collection bin 102. The collection bin 102 is part of the waste collection system 100. The waste collection system 100 includes a waste collection vehicle (WCV) 101 and a collection bin 102. The collection bin 102 includes a body (or collection bin body) 106 and a bag (or collection bin bag) 108. FIGS. 6 and 7 illustrate embodiments of a bag 108. FIGS. 8 and 9 illustrate an embodiment of a body 106. In one embodiment, as illustrated in FIG. 1, the WCV 101 is a front loading WCV 101. In an alternative embodiment, the waste collection system 100 includes a side loading WCV 101 instead of a front loading WCV 101. In yet another embodiment, the waste collection system 100 further includes an automated robotic arm 107, an automated cover, and/or a weighing system.

As illustrated, the waste collection vehicle 101 includes a vehicle and an automated lifting device 104 (or an automated lifting apparatus), such as a fork. The lifting device 104 is referred to as automated because the movement of the lifting device 104 is automated or partially automated upon initiation by an operator. In one embodiment, the automated lifting device 104 is powered by utilizing systems already implemented on the WCV 101, such as a power system, a hydraulic system, and/or a pneumatic system. In an alternative embodiment, the automated lifting device 104 is powered independently of the WCV 101.

In one embodiment, the WCV 101 includes a hopper. In another embodiment, the hopper may include a packing blade. The hopper is designed to receive and hold the materials lifted by the automated lifting device 104.

WCVs 101 are typically designed for commercial waste containers, such as dumpsters. Commercial waste containers are typically sized to hold from about 1 cubic yard (about 0.7646 cubic meters) to about 10 cubic yards (about 7.646 cubic meters) of material. These sizes are exemplary only and are not meant to limit the disclosure. WCVs 101 are normally designed for the lifting of commercial waste containers and are not designed for the automated lifting of non-commercial, residential, or smaller sized waste containers. Smaller sized waste containers typically hold from about 25 gallons (about 94.64 liters) to about 100 gallons (about 378.5 liters) of material. These sizes are exemplary only and are not meant to limit the disclosure. The collection bin 102 allows any front or side loading WCV 101 to be adapted to automatically load and empty these smaller sized waste containers.

WCVs 101 are typically configured to receive commercial waste containers on the automated lifting device 104. In one embodiment, a fork of the waste collection vehicle 101 receives the commercial waste container. The fork is designed to engage standardized commercial waste containers (e.g., dumpsters).

In embodiments of the present system, a collection bin 102 is provided on the automated lifting device 104. In operation, waste from the waste containers is transferred into the collection bin 102 (e.g., manually or through the use of a robotic arm 107 as described below) and, when the collection bin 102 is full or at the discretion of the operator, the waste in the collection bin 102 is dumped into the hopper using the automated lifting device 104.

The collection bin 102 includes a body 106 and a bag 108 attached to the body 106. In one embodiment, the body 106 and the bag 108 are inseparable once attached. In an alternative embodiment, the body 106 and the bag 108 are separable from each other even after attachment.

The bag 108 is a fabric-like material configured to form a receptacle. The receptacle is suitable for holding and/or collecting waste on a waste collection vehicle 101. The bag 108 includes four sides 114, 116, 118, and 120 connected to a base 122 to form the receptacle as illustrated in FIGS. 1-7 and 10-12. The four sides 114, 116, 118, and 120 are a front side 114, a right side 116, a left side 118, and a rear side 120. Each of the four sides 114, 116, 118, and 120 includes a top end and a lower end. The lower end attaches to the base 122. The top ends of the four sides 114, 116, 118, and 120 are opposite the lower ends of the four sides 114, 116, 118, and 120. The front side 114 is attached to the right side 116 and the opposite left side 118. The front side 114 is opposite the rear side 120. The rear side 120 is attached to the right side 116 and the opposite left side 118. The rear side 120 is located closest to the WCV 101 when the bag 108 is attached to the body 106 and the body 106 is attached to the WCV 101. As discussed above and as illustrated in FIGS. 1-7 and 10-12, the base 122 attaches to the lower ends of the four sides 114, 116, 118, and 120. In some embodiments, the base 122 includes a recessed portion 124. The recessed portion 124 may provide a space for a portion of the body 106.

In some embodiments, the bag 108 includes a body attachment portion 130 that provides a mechanism for assisting the attachment of the bag 108 to the body 106. In some embodiments, the body attachment portion 130 is at least one flange 132 attached to the top edge of one of the four sides 114, 116, 118, and 120. In other embodiments, a flange 132 is attached to the top edge of each of the four sides 114, 116, 118, and 120 as illustrated in FIGS. 1-7 and 10-12.

Figure 10:
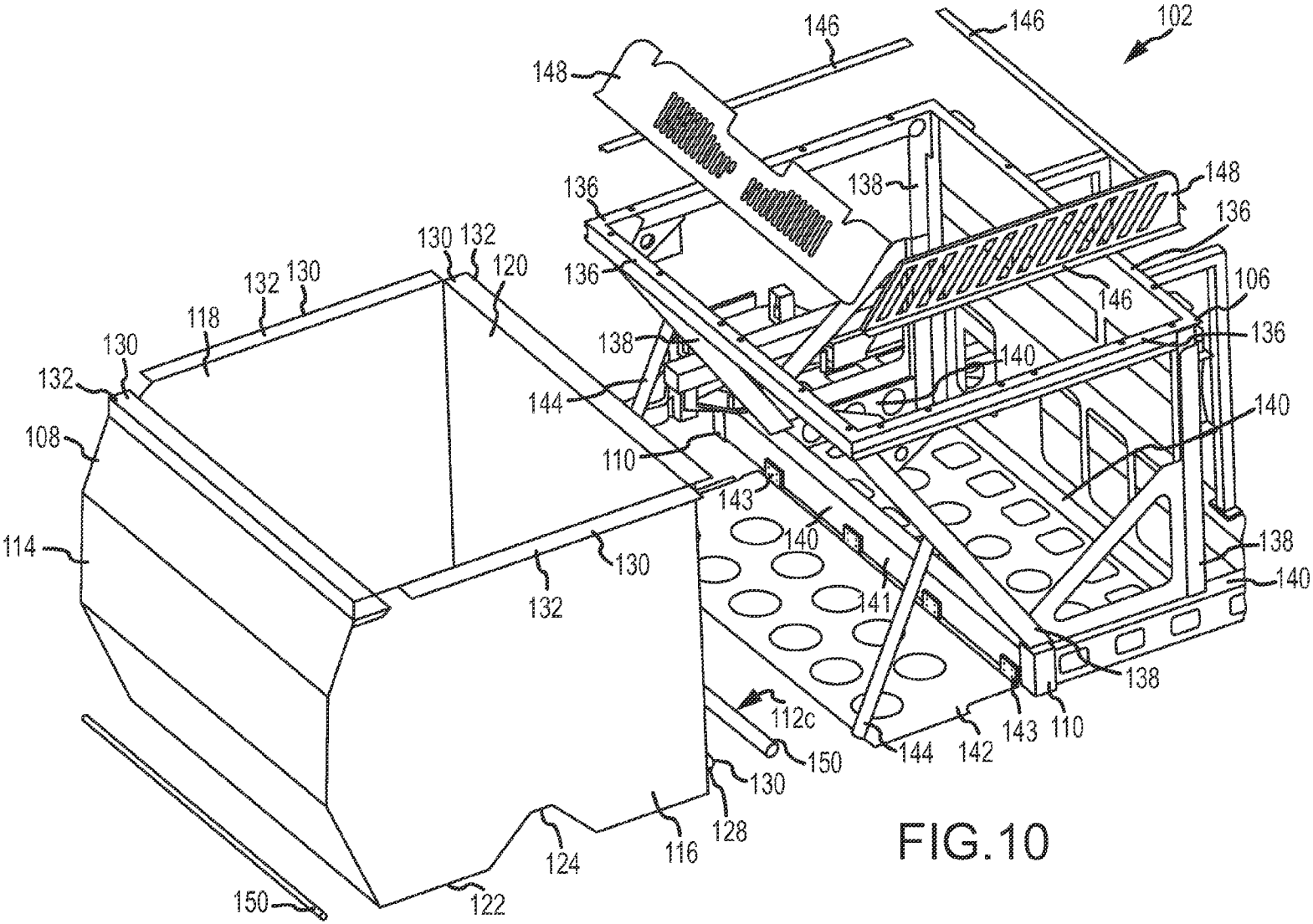
FIG. 10 is an exploded front, right side, isometric view of one embodiment of a collection bin.
Figure 11:
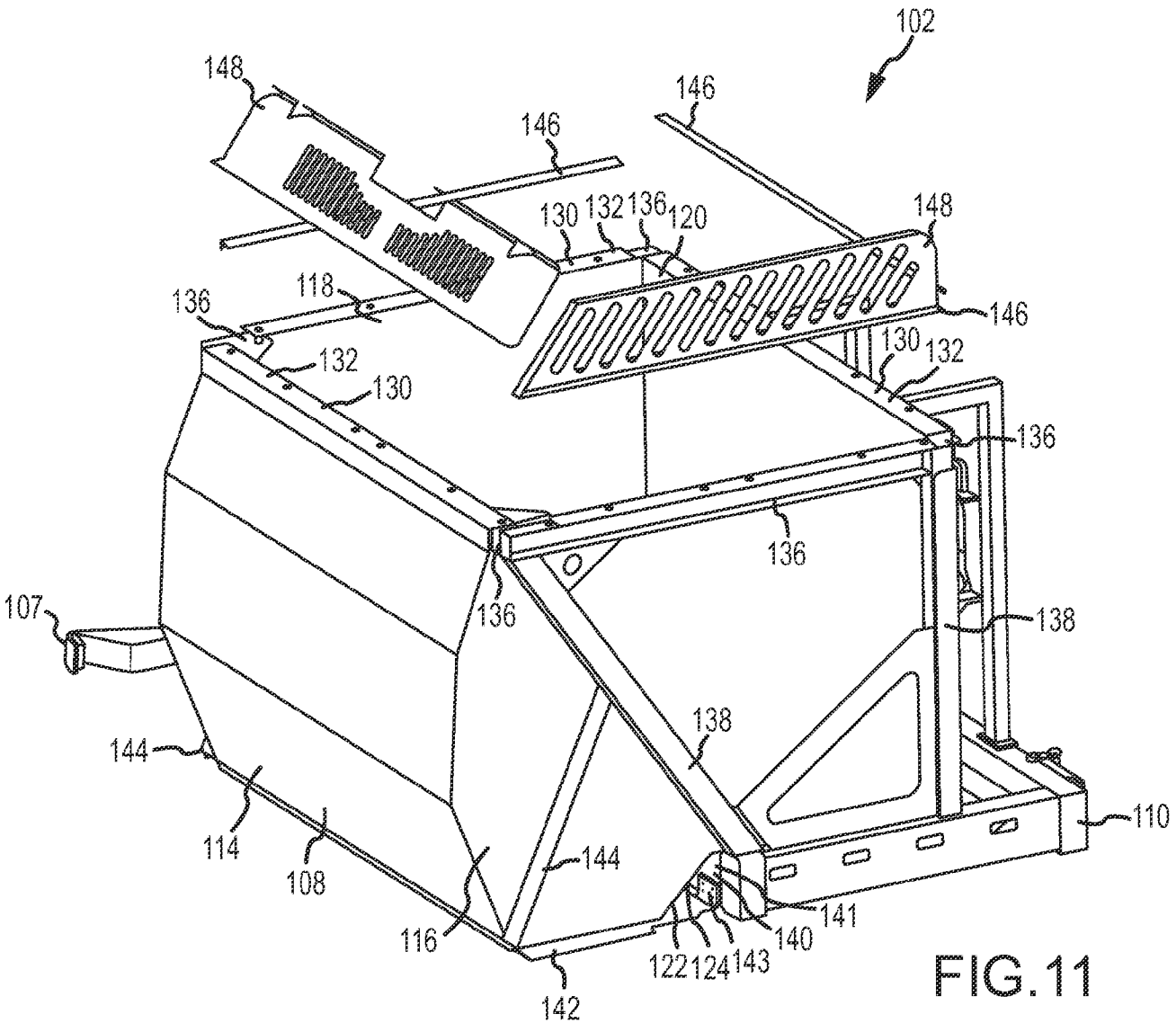
FIG. 11 is a partially exploded, front, right side, isometric view of one embodiment of a collection bin.

In some embodiments, the body attachment portion 130 is a channel 134. The channel 134 is a passageway or tunnel formed in the fabric-like material of the bag 108 as illustrated in FIGS. 7 and 10. The channel 134 may be located on one or more of the four sides 114, 116, 118, and 120. Further, the channel 134 may be located on the interior portion or the exterior portion of one or more of the four sides 114, 116, 118, and 120. The interior portion is the portion of the front 114, right 116, left 118, and/or rear 120 sides that faces the other sides and/or forms the portion of the receptacle for holding materials. The exterior portion is the portion of the front 114, right 116, left 118, and/or rear 120 sides that is opposite the interior portion. Further, the channel 134 may be located in any position on one of the four sides 114, 116, 118, and 120. In some embodiments, the channel 134 may be located near the top end, lower end, or center on one of the four sides 114, 116, 118, and 120. For example, a lower interior channel 128 on the front side 114 of the bag 108 may be utilized. In another example, a lower exterior channel 128 attached to the rear side 120 is utilized as illustrated in FIGS. 7 and 10.

Further, the fabric-like material is any flexible material suitable for the collection of waste on a waste collection vehicle 101. In one embodiment, the fabric-like material includes polyester, nylon, Kevlar®, Nomex®, Teflon®, Carbon/graphite, ceramic, Gore-Tex®, Ryton®, S-Glass, Nextel®, Quartz, Twaron®, Vectran®, Spectra®, E-Glass, zylon, aramid yarn, and/or polypropylene. For example, in some embodiments, the bag 108 is made of a 40-ounce vinyl material or a coated polyester material. In other embodiments, the bag 108 is lined with an aramid yarn, such as Kevlar® and/or coated with a water tight coating. The bag 108 may be one piece of fabric-like material or configured from multiple pieces of fabric-like material.

The bag 108 is lightweight. The bag 108 weighs less than the body 106. In one embodiment, the bag 108 weighs 50% less than the body 106. In another embodiment, the bag 108 weighs 75% less than the body 106. In one embodiment, the bag 108 weighs less than 35 pounds. The fabric-like material of the bag 108 provides for a light-weight collection bin 102. The collection bin 102 with a bag 108 weighs at least 200 pounds less than previously utilized collection bins that utilize solid or substantially inflexible bin materials. This significant reduction of weight compared to previously utilized collection bins helps reduce the overall weight of collection systems. Because the collection bin 102 weighs less, the collection bin 102 is moved with less energy and accordingly reduces emissions and fuel consumption for the collection system.

The fabric-like material of the bag 108 may be designed to provide additional benefits. For instance, in one embodiment, the fabric-like material is flexible and can be easily removed from the body 106 for storage and cleaning. In an additional embodiment, the bag 108 may be designed to be inexpensive and easily replaced if damaged. Further, the fabric-like material of the bag 108 reduces the overall weight of the collection bin 102 decreasing the wear and tear on the waste collection vehicle 101 resulting in lower maintenance costs and/or an increased life-span for the collection vehicle.

The fabric-like material of the bag 108 may also be further treated or designed for specific uses and/or applications. In one embodiment, the fabric-like material of the bag 108 is treated and/or designed to withstand outdoor elements, such as extreme temperatures, sun exposure and water exposure. In another embodiment, the fabric-like material of bag 108 is water proof and/or fire proof. In a further embodiment, the fabric-like material of bag 108 may include small holes, which allow air to travel through the bag 108 to reduce smell and heat within the bag 108.

In one embodiment, the bag 108 is designed to hold from about 1 cubic yard (about 0.7646 cubic meters) to about 10 cubic yards (about 7.646 cubic meters) of material. In a further embodiment, the bag 108 is designed to hold from about 3 cubic yards (about 2.294 cubic meters) to about 5 cubic yards (about 3.823 cubic meters) of material. These sizes are exemplary only and are not meant to limit the disclosure.

In another embodiment, the bag 108 is designed to be disposable. Accordingly, the bag 108 may be designed for a single use or single filling. Alternatively, the bag 108 may be designed for limited or unlimited uses or fillings.

The body 106 is a substantially non-flexible material configured to frame the bag 108 when attached to the body 106. The body 106 provides a structurally solid frame for holding the bag 108. The body 106 includes at least four top bars 136, at least two bottom bars 140, and at least two side bars 138 connecting the top bars 136 to the bottom bars 140 to form the frame as illustrated in FIGS. 1-5 and 8-12. In some embodiments, the body 106 includes at least four bottom bars 140 and/or at least four side bars 138. Further, the body 106 provides structurally solid apparatuses for attaching the bag 108 to the waste collection vehicle 101.

The body 106 includes a lifting device attachment 110. The lifting device attachment 110 is suitable for attaching the body 106 to the automated lifting device 104 of the waste collection vehicle 101. The lifting device attachment 110 may be any suitable means for allowing the body 106 to attach to the automated lifting device 104 of the waste collection vehicle 101, such as a pocket, a bolting system, and welding system. In one embodiment, the lifting device attachment 110 provides a permanent attachment. In another embodiment, the lifting device attachment 110 is removable and/or reusable.

In one embodiment, the automated lifting device attachment 110 of the body 106 is attached to a fork by at least one pocket on the body 106. A pocket is any suitable method for attaching a collection bin 102 to a fork of a waste collection vehicle 101. As illustrated in FIG. 1, in one embodiment, pockets are openings that align and slip over the prongs of the fork of the front or side loading WCV 101. The collection bin 102 allows any front or side loading WCV 101 to be adapted to perform waste/material removal from non-commercial waste containers or smaller waste containers.

In some embodiments, the body 106 further includes a guard platform 142. The guard platform 142 is movably attached via moveable attachment 143 to one of the four bottom bars 140. In some embodiments, the guard platform 142 is attached to a front bottom bar 141. In some embodiments, a recessed portion 124 makes room for the front bottom bar 141. The front bottom bar 141 is the bottom bar 140 located farthest from a waste collection vehicle 101 when the body 106 is attached to the waste collection vehicle 101. In some embodiments, the moveable attachment 143 is a hinge, which allows the guard platform 142 to pivot towards and away from the side bars 138. In some embodiments, the guard platform 142 is also attached to the two adjacent side bars 138 opposite of each other as illustrated in FIGS. 1, 2, 3, 5, and 8-12. The guard platform 142 is attached to the adjacent side bars 138 via platform supports 144. The platform supports 144 may be a resilient/retractable or biasing member, such as spring, elastic band, chain, and/or rubber band.

The bag 108 is attached to the body 106 with one or more body attachment 112. The body attachment 112 is any suitable mechanism for attaching the bag 108 to the body 106, such as welding systems, bolting systems 112*a*, hinge systems, strap systems 112*b*, button systems, channel systems 112*c*, clamping systems, and/or snap systems. In one embodiment, the body attachment 112 is a permanent attachment. In an alternative embodiment, the body attachment 112 may be a removable and/or reusable attachment. As used herein, any attachment utilized for attaching the bag 108 to a portion of a top bar 136 is referred to herein as a top bar attachment.

Figure 12:
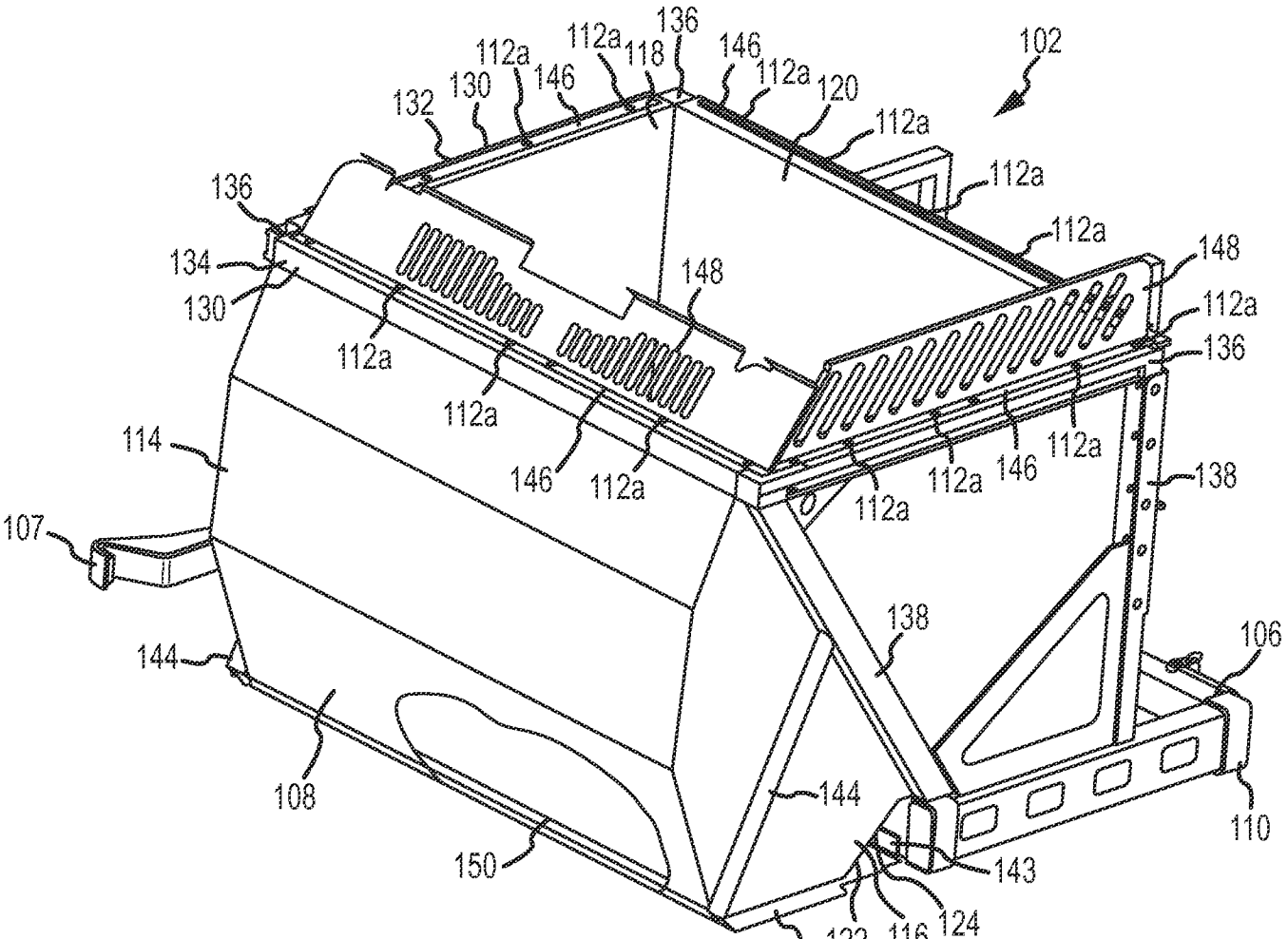
FIG. 12 is a front, right side, isometric view including a cut-out portion of one embodiment of a collection bin.
Figure 13:
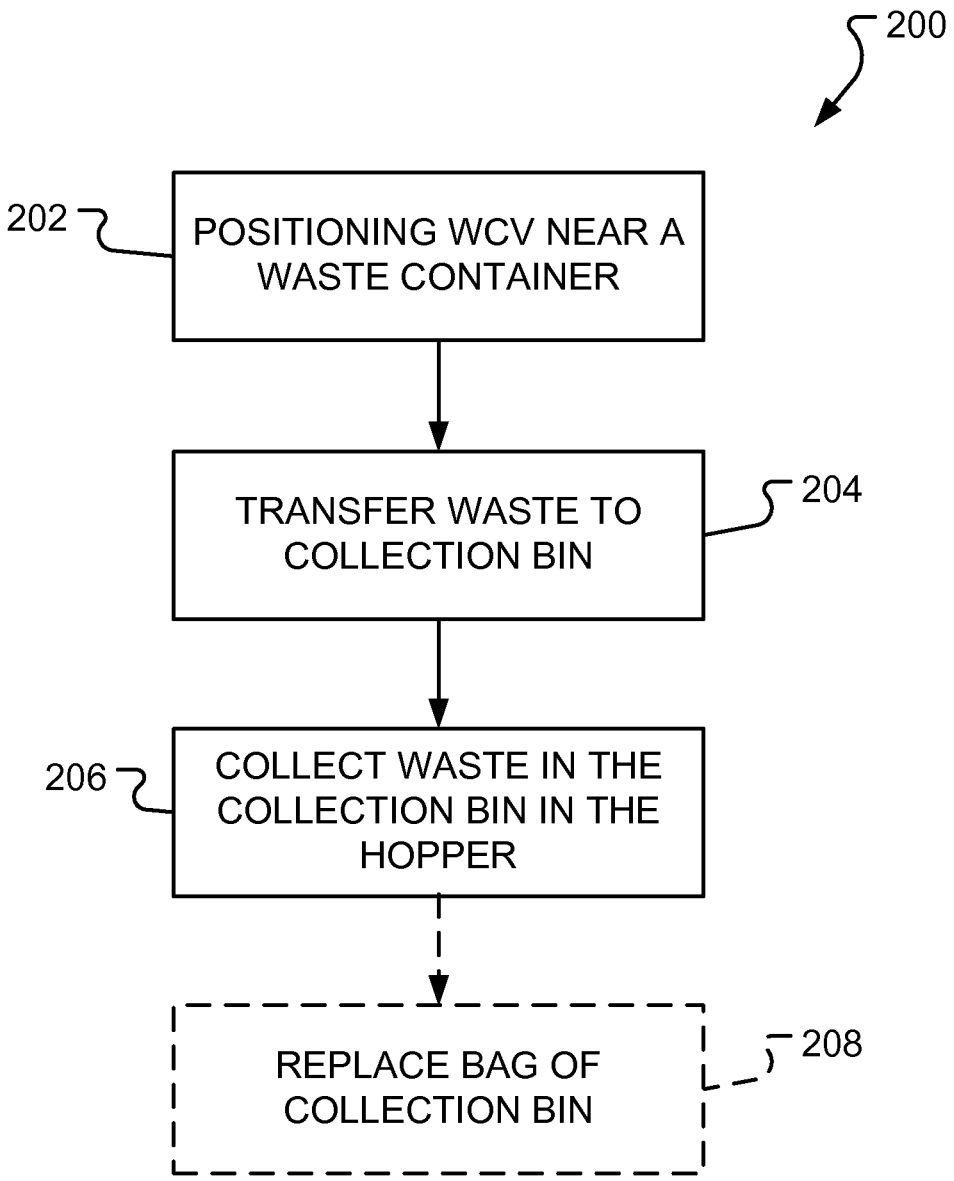
FIG. 13 is an embodiment of a method for reducing fuel emissions of a waste collection system.

In one embodiment, the body attachment 112 is a set of multiple and/or varying attachments. For example, FIGS. 5, 10, and 12 illustrates the use of two different body attachments 112. In FIGS. 4 and 5, the bag 108 is attached to the body 106 via bolting 112*a* and nylon straps 112*b*. In FIGS. 10 and 12, the bag 108 is attached to the body 106 via bolting 112*a* and a channel system 112*c*.

In some embodiments, the top of the bag 108 or a flange 132 is placed between an intermediate plate 146 and the body 106. In some embodiments, the intermediate plate 146 includes a shield 148. The shield 148 may provide several different functions, such as preventing materials from leaving the collection bin 102, preventing unwanted materials from entering the collection bin 102, and/or preventing passersby from being able to see the materials contained within the collection bin 102. A body attachment 112, such as bolts of a bolting system 112*a*, extend through the plate 146 and/or shield 148, the bag 108, and the body 106 to attach the top portion of the bag 108 or a flange 132 to the top bars 136 of the body 106. However, any portion of the bag 108 may be attached, such as bolted, to any portion of the body 106 with or without the use of an intermediate plate 146. For example, in some embodiments, the base 122 of the bag 108 is placed between an intermediate plate 146 and a bottom bar 140 of the body 106 and then bolted together to attach a portion of the bag 108 to the body 106. These embodiments, where the base 122 of the bag 108 is bolted to a bottom bar 140 utilizing an intermediate plate 146, are configured to hold the base 122 in place, such that when the bag 108 is inverted the bag 108 does not lose its shape or pull away from the body 106.

In further embodiments, nylon straps with plastic clips or hook and loops systems 112*b* are attached to the bag 108 adjacent to side bars 138, top bars 136, and/or bottom bars 140 of the body 106. The nylon strap 112*b* wrap around a portion of the body 106 to hold different portions of the bag 108 in place on the body 106 as illustrated in FIG. 5.

In additional embodiments, the body attachment 112 is a channel attachment system 112*c*. In a channel attachment system 112*c* a tube, bar 150, plate 146, clamp, strip, and/or any other suitable device for extending through a channel 128 of the bag 108 is placed inside the channel 128 and attached to the body 106. For example, a bar 150 may be slid through an exterior channel 128 and attached to side bars 138 opposite each other of the body 106 as illustrated in FIGS. 7 and 10. In another embodiment, a plate 146 is placed through the interior channel 128 and attached to the opposite side bars 138 or opposite bottom bars 140 of the body 106 and attached to the base 122 or sides 114, 116, 118, and 120 of the bag 108. In some of these embodiments, the channel attachment system 112*c* locks a portion of the bag 108, such as the base 122 in place, such that when the bag 108 is inverted the bag 108 does not lose the its shape or pull away from the body 106.

In some embodiments, the a tube, bar 150, plate 146, or clamp spanning the length of the bag 108 and located adjacent to a side or base 122 of the bag 108 may be attached through the two sides 114, 116, 118, and 120 of bag 108 to the opposite side bars 138 of the body 106 in order to hold the bag 108 in place and in a desired shape. For example, a bar 150 may extend from a first side bar 138 to an opposite side bar 138 across the length of the bag 108 and adjacent to the corner where the front side 114 attaches to the base 122 as illustrated in FIGS. 10 and 12 Such an embodiment, helps to lock a portion of the bag 108, such as the base 122 in place, such that when the bag 108 is inverted the bag 108 does not lose its shape or pull away from the body 106.

These body attachment 112 configurations are exemplary only and are not meant to be limiting. Any suitable method for attaching the bag 108 to the body 106 as known by a person of skill in the art may be utilized. For example, in some embodiments, the top of the bag 108 is configured to form a sleeve that slips around a top portion of the body 106. Further, this sleeve may be bolted or stapled to the body 106.

In one embodiment, the waste containers are manually lifted and emptied into the collection bin 102. In another embodiment, the waste containers are emptied into a collection bin 102 with a semi-automated cart tipper.

Figure 3:
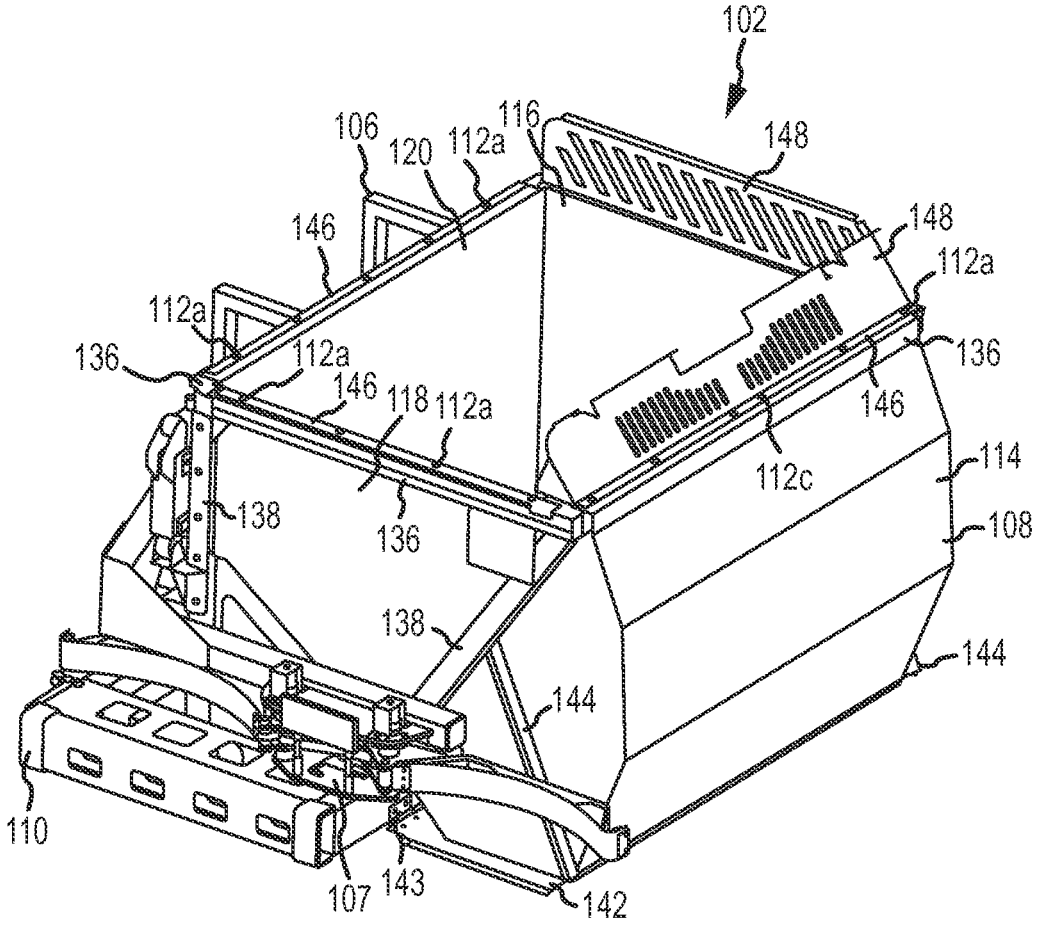
FIG. 3 is a front, left side, isometric view of one embodiment of a collection.

In yet another embodiment, the collection system further includes an automated robotic arm 107 attached to the body 106 of collection bin 102 as illustrated in FIGS. 3, 8, and 9. In an alternative embodiment, the robotic arm 107 is directly attached to the automated lifting device 104. In a further embodiment, the robotic arm 107 is directly attached to a cab and/or hopper of the waste collection vehicle 101.

The robotic arm 107 is referred to as automated because the grabbing, lifting, dumping, and setting down of the waste container by the robotic arm 107 may be performed automatically upon the initiation of the actions by an operator command after the robotic arm 107 is manually positioned. The automated robotic arm 107 may be any suitable robotic arm 107 for the automated grabbing, lifting, and emptying of waste containers. In one embodiment, the collection bin 102 and/or the robotic arm 107 may be any of the types disclosed in U.S. Pat. No. 7,210,890 filed on Oct. 16, 2003, which is incorporated herein in its entirety. In one embodiment, the automated robotic arm 107 is powered by utilizing systems already implemented on the WCV 101, such as a power system, a hydraulic system, and/or a pneumatic system. In an additional embodiment, the automated robotic arm 107 grabs, lifts, and disposes of any type/shape of waste container or any bulky item, such as furniture, appliances, barrels, or crates.

In one embodiment, the body 106 further includes a weighing system comprising one or more load cells for weighing the contents of the collection bin 102. In another embodiment, the load cells of the weighing system are located on the automated lifting device 104. In a further embodiment, the load cells are located in the hopper of the waste collection vehicle 101.

The weighing system allows an operator to weigh all of the materials collected by the waste collection vehicle 101. In some embodiment, it allows the operator to weigh the amount of waste collected per household, per customer, and/or per route. Accordingly, the weighing system is an ideal tool for collecting recyclables that allows for accurate determinations of recycling amounts per customer, household, or area. Further, current collection and transport vehicles charge by volume regardless of the amount of materials collected. The weighing system allows an operator to charge by weight of the material collected.

In one embodiment, an automated cover is attached to the body 106 of the collection bin 102. In an additional embodiment, the automated cover is attached to the bag 108 of the collection bin 102. In another embodiment, the automated cover is attached to the automated lifting device 104. Any suitable system for attaching the automated cover to the collection bin 102 and/or waste collection vehicle 101 may be utilized, such as a welding system and/or bolting system. The automated cover provides for a system that prevents unnecessary littering from the collection bin 102 during use and/or transport between customers or when the collection bin 102 is dumped into the hopper of the WCV 101.

Figure 2:
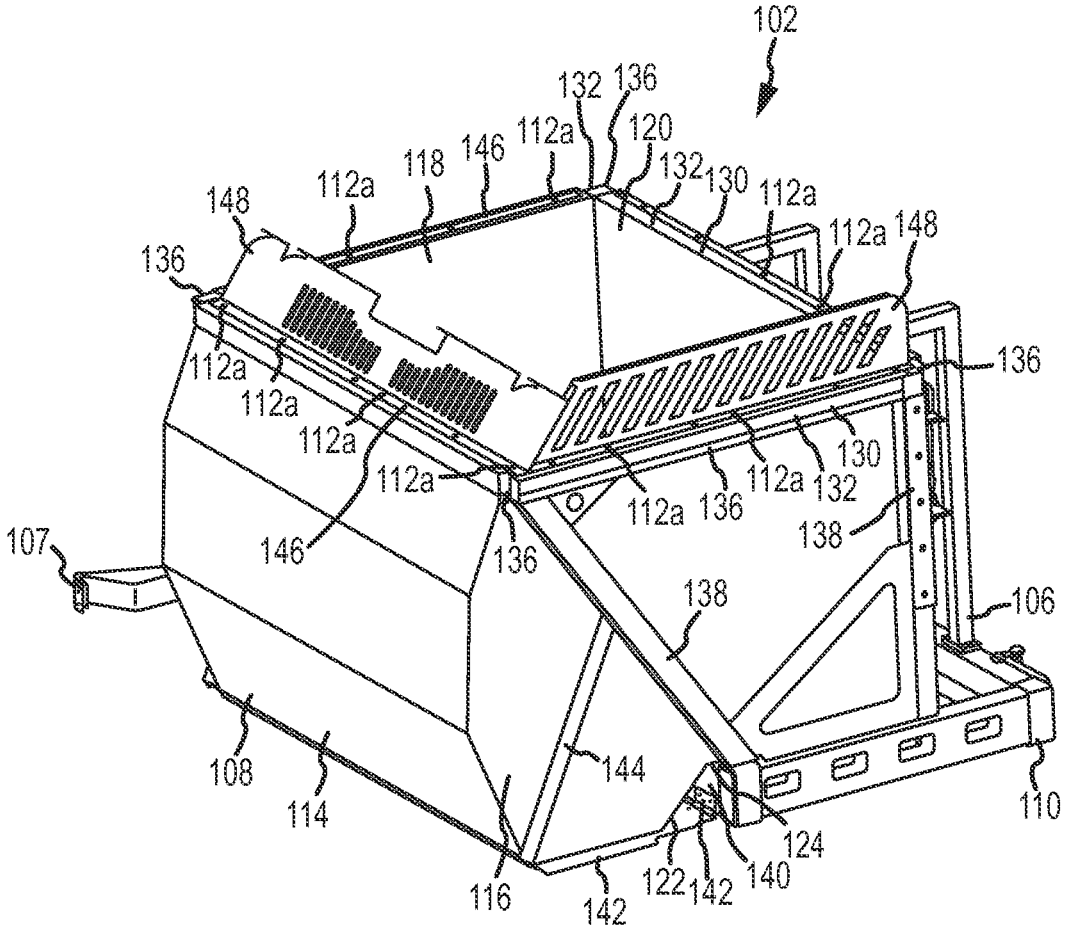
FIG. 2 is a front, right side, isometric view of one embodiment of a collection bin.

FIG. 2 illustrates an embodiment of a method 200 for reducing the fuel emissions of a waste collection system. Method 200 includes a positioning operation 202. The positioning operation 202 positions a waste collection vehicle near a waste container. As described above, the waste container vehicle is equipped with a lightweight, flexible collection bin. Accordingly, the collection bin includes a collection bin bag made of fabric-like material and a collection bin body, such as the body 106 and/or bag 108 as described above and as illustrated in FIGS. 1-12.

After the positioning operation 202, a transferring operation 204 is performed by method 200. The transferring operation 204 transfers waste from a container into the collection bin. As described above, the transferring operation 204 may be performed manually or through the assistance of an automated or partially automated system, such as a robotic arm.

Next, upon command, a collection operation 206 is performed by method 200. The collection operation 206 collects the waste in the collection bin in a hopper (i.e., the waste is transferred from the collection bin to the hopper). The collection operation 206 is at least partially automated. In one embodiment, the collection operation 206 is performed by an automated lifting device. In some embodiments, the automated lifting device is an automated fork lift. The command may be issued at the discretion of an operator of the waste collection vehicle/collection bin or issued automatically upon determining that the collection bin is full.

In an additional embodiment, method 200 further performs a replacement operation 208 after the collection operation 206. The replacement operation 208 replaces the bag of the collection bin. Accordingly, method 200 may or may not utilize a disposable collection bag. In an embodiment with a disposable bag, the collection operation 206 may further include the collection of the collection bag in the hopper.

This method 200 results in reduced emissions and fuel consumption compared to methods that utilized semi-rigid collection bins. The use of the fabric-like material reduces the overall weight of a collection bin, so the positioning operation 202, transferring operation 204, and collection operation 206 are performed by a vehicle having a substantially lower weight than that of a vehicle using a semi-rigid collection bin. For example, a waste collection vehicle utilizing a fabric-like material for the collection bin may weigh at least 200 pounds less than a waste collection vehicle utilizing a rigid collection bin. Accordingly, in one embodiment, the positioning operation 202, the transferring operation 204, and/or collection operation 206 are performed repeatedly. This reduction in weight provides for lower emissions and fuel consumption. Further, the fabric-like material of the collection bin bag reduces the overall weight of the collection bin decreasing the wear and tear on the waste collection vehicle resulting in lower maintenance costs and/or an increased life-span for the collection vehicle.

Those skilled in the art will recognize that the methods and systems of the present disclosure may be implemented in many manners and as such are not to be limited by the foregoing exemplary embodiments and examples. In this regard, any number of the features of the different embodiments described herein may be combined into single or multiple embodiments, and alternate embodiments having fewer than or more than all of the features herein described are possible. Moreover, the scope of the present disclosure covers conventionally known manners for carrying out the described features and functions, and those variations and modifications that may be made as would be understood by those skilled in the art now and hereafter.

While various embodiments have been described, various changes and modifications may be made which are well within the scope of the present disclosure. For example, any number of actuator systems, drive systems, pivot systems, covers, robotic arms, and/or weighing systems may be utilized. Further, numerous other changes may be made which will readily suggest themselves to those skilled in the art and which are encompassed in the spirit of the disclosure and as defined in the appended claims.

What is claimed is:

1. A light-weight collection bin for reducing fuel emissions, comprising:

a collection bin bag, the collection bin bag is made of a lightweight and flexible material configured to form a receptacle with at least a partially open top, the receptacle with the at least a partially open top is configured to receive and dump waste, the collection bin bag includes four sides attached to a base, an exterior channel attached to a rear side of the four sides, and a plurality of flanges, each flange extending from a top edge of a different one of the four sides;

a collection bin body, the collection bin body is made of a substantially non-flexible material, wherein the collection bin body is a frame that includes at least four top bars, at least four bottom bars, and at least two side bars connecting the top bars to the bottom bars;

a plurality of top bar attachments including an intermediate plate, the plurality of top bar attachments attach each of the flanges extending from the top edges of each of the four sides of the collection bin bag to the collection bin body, wherein at least one of the flanges is positioned between at least one of the top bars and the intermediate plate;

an interior bar attaching through a right side and a left side of the four sides of the collection bin bag to a first side bar and an opposite second side bar of the at least two side bars of the collection bin body, the interior bar positioned adjacent to the base;

a lower rear bar for attaching the rear side of the collection bin bag via the exterior channel to the first side bar and the opposite second side bar of the collection bin body; and a lifting device attachment, the lifting device attachment is located on the collection bin body and allows a lifting device of a waste collection vehicle to engage and lift the collection bin.

2. The light-weight collection bin of claim 1, further comprising:

a recessed portion in the base.

3. The light-weight collection bin of claim 1, wherein the collection bin body includes a guard platform.

4. The light-weight collection bin of claim 3, wherein the guard platform is pivotally attached to a front bottom bar of the at least four bottom bars and the guard platform is attached to the first side bar with a first front platform support and to the opposite second side bar with a second front platform support.

5. The light-weight collection bin of claim 1, wherein the plurality of top bar attachments are bolting systems.

6. The light-weight collection bin of claim 1, wherein the collection bin bag is lined with aramid yarn.

7. The light-weight collection bin of claim 1, wherein the collection bin bag includes a water tight coating.

8. The light-weight collection bin of claim 1, wherein the collection bin bag is disposable.

9. The light-weight collection bin of claim 1, wherein the collection bin bag weighs less than 35 pounds.

10. The light-weight collection bin of claim 1, wherein an overall weight of the light-weight collection bin is 1680 pounds or less.

11. A waste collection system for reducing fuel emissions, the waste collection system comprising:

a waste collection vehicle, the waste collection vehicle includes an automated lifting apparatus, wherein the automated lifting apparatus is a fork;

a light-weight collection bin, the light-weight collection bin comprising:

a collection bin bag, the collection bin bag is made of a light weight and flexible material configured to form a receptacle with at least a partially open top, the receptacle with the at least a partially open top is configured to receive and dump waste;

a collection bin body, the collection bin body is a frame made of substantially non-flexible material configured to frame the collection bin bag when the collection bin bag is attached to the collection bin body;

at least one body attachment, the at least one body attachment attaches the collection bin bag to the collection bin body;

a lifting device attachment, the lifting device attachment is attached to at least one bottom bar of the collection bin body and includes two pockets that align and slip over two prongs of the fork for connecting the lifting apparatus of the waste collection system to the collection bin body of the light-weight collection bin for automated dumping of contents of the collection bin bag into a hopper of the waste collection vehicle.

12. The waste collection system of claim 11, wherein the collection bin bag includes:

four sides attached to a base, an exterior channel attached to a rear side of the four sides, and a plurality of flanges, each flange extending from a top edge of a different one of the four sides, wherein the collection bin body includes:

at least four top bars, at least four bottom bars, and at least two side bars connecting the top bars to the bottom bars, and wherein the at least one body attachment includes:

a plurality of top bar attachments including an intermediate plate, the plurality of top bar attachments attach each of the flanges extending from the top edges of each of the four sides of the collection bin bag to the collection bin body, an interior bar attaching through a right side and a left side of the four sides of the collection bin bag to a first side bar and an opposite second side bar of the at least two side bars of the collection bin body, the interior bar positioned adjacent to the base, and a lower rear bar for attaching the rear side of the collection bin bag via the exterior channel to the first side bar and the opposite second side bar of the collection bin body.

13. The waste collection system of claim 11, wherein an overall weight of the light-weight collection bin is 1680 pounds or less.

14. The waste collection system of claim 11, wherein the collection bin body includes a guard platform.

15. The waste collection system of claim 14, wherein the guard platform is pivotally attached to a front bottom bar and the guard platform is attached to a first side bar with a first front platform support and to an opposite second side bar with a second front platform support.

16. The waste collection system of claim 11, further comprising:

an automated robotic arm attached to the collection bin body of the light-weight collection bin.

17. The waste collection system of claim 11, wherein the collection bin bag is lined with aramid yarn.

18. The waste collection system of claim 11, wherein the collection bin bag includes a water tight coating.

19. The waste collection system of claim 11, wherein the collection bin bag is disposable.

20. A light-weight collection bin for reducing fuel emissions, comprising:

a collection bin bag, the collection bin bag is made of a lightweight and flexible material configured to form a receptacle with at least a partially open top, the receptacle with the at least a partially open top is configured to receive and dump waste;

a collection bin body, the collection bin body is made of a substantially non-flexible material configured to frame the collection bin bag when the collection bin bag is attached to the collection bin body;

a lifting device attachment, the lifting device attachment is attached to at least one bottom bar of located on the collection bin body and includes two pockets that are positioned to align and slip over two prongs of a fork of a waste collection vehicle to allow the fork of the waste collection vehicle to engage the collection bin for automated dumping of contents of the collection bin bag into a hopper of the waste collection vehicle; and at least one body attachment, the at least one body attachment attaches the collection bin bag to the collection bin body.

21. The light-weight collection bin of claim 8, wherein the collection bin bag is designed to withstand extreme temperatures, sun exposure, and water.

22. The waste collection system of claim 19, wherein the collection bin bag is designed to withstand extreme temperatures, sun exposure, and water.

23. The light-weight collection bin of claim 1, wherein the material comprises at least one of polyester, nylon, aramid yard, aramid polymer with a nylon backbone, polytetrafluoroethylene, stretched polytetrafluoroethylene, polyphenylene sulfide, liquid crystal polymer, high modulus polyethylene, graphite ceramic, E-glass, zylon, and polypropylene.

24. The waste collection system of claim 11, wherein the material comprises at least one of polyester, nylon, aramid yard, aramid polymer with a nylon backbone, polytetrafluoroethylene, stretched polytetrafluoroethylene, polyphenylene sulfide, liquid crystal polymer, high modulus polyethylene, graphite ceramic, E-glass, zylon, and polypropylene.

25. The light-weight collection bin of claim 20, wherein the material comprises at least one of polyester, nylon, aramid yard, aramid polymer with a nylon backbone, polytetrafluoroethylene, stretched polytetrafluoroethylene, polyphenylene sulfide, liquid crystal polymer, high modulus polyethylene, graphite ceramic, E-glass, zylon, and polypropylene.

* * * * *